US005165850A

United States Patent [19]

Humke et al.

[11] Patent Number: 5,165,850

[45] Date of Patent: Nov. 24, 1992

[54] COMPRESSOR DISCHARGE FLOWPATH

[75] Inventors: Brian J. Humke, Cincinnati; Donald L. Bellia; Eric E. Baehre, both of West Chester; Michael L. Barron, Loveland, all of Ohio; Thomas G. Wakeman, Lawrenceburg, Ind.

[73] Assignee: General Electric Company, Cincinnati, Ohio

[21] Appl. No.: 729,956

[22] Filed: Jul. 15, 1991

[51] Int. Cl.[5] ..... F01D 1/02

[52] U.S. Cl. ..... 415/209.2; 415/135; 415/139; 415/208.2; 415/210.1; 415/211.2

[58] Field of Search ..... 415/134, 135, 139, 182.1, 415/208.1, 208.2, 209.2, 210.1, 211.2, 213.1

[56] References Cited

U.S. PATENT DOCUMENTS

| | | | |
|---|---|---|---|
| 2,634,090 | 4/1953 | Hardigg | 415/135 |
| 3,425,665 | 2/1969 | Lingwood | 415/134 |
| 3,631,674 | 1/1972 | Taylor | 415/211.2 X |
| 3,709,637 | 1/1973 | Petrie et al. | 415/134 X |
| 3,959,966 | 6/1976 | Pearce et al. | 415/139 X |
| 4,483,149 | 11/1984 | Rider et al. | 60/751 |
| 4,487,015 | 11/1984 | Stattery et al. | 60/39.32 |
| 4,716,721 | 1/1988 | Pask et al. | 415/213.1 X |
| 4,907,743 | 3/1990 | Bouiller et al. | 239/265.11 |
| 4,907,946 | 3/1990 | Ciokajlo et al. | 415/209.3 |
| 5,077,967 | 1/1992 | Widener et al. | 415/208.1 X |

FOREIGN PATENT DOCUMENTS

| | | | |
|---|---|---|---|
| 136485 | 2/1950 | Australia | 415/134 |

*Primary Examiner*—Edward K. Look
*Assistant Examiner*—Todd Mattingly
*Attorney, Agent, or Firm*—Jerome C. Squillaro

[57] ABSTRACT

A compressor discharge flowpath for a gas turbine engine includes flowpath outer and inner walls joined to a plurality of circumferentially spaced flowpath dividers extending therebetween. An inner support extends from the inner wall and is joined to a turbine nozzle, and an outer support extends from the outer wall and is joined to an engine casing. The outer support preferably includes a plurality of circumferentially spaced beams being sized and configured for carrying both axial force and torque transmitted therethrough from the turbine nozzle to the casing while allowing the beams to bend radially for accommodating differential thermal movement between the casing and the outer wall.

13 Claims, 4 Drawing Sheets

COMPRESSOR DISCHARGE FLOWPATH

TECHNICAL FIELD

The present invention relates generally to gas turbine engines, and, more specifically, to the discharge flowpath between a compressor and combustor thereof configured for carrying loads from a turbine nozzle disposed downstream of the combustor.

BACKGROUND ART

A conventional gas turbine engine includes in serial flow communication a compressor, a discharge flowpath having compressor outlet guide vanes (OGVs) and a combustor diffuser, a combustor, a turbine nozzle, and a high pressure turbine. During engine operation, the compressor compresses inlet airflow, which is therefore heated thereby, with the discharged compressed and heated airflow being channeled through the OGVs and the diffuser to the combustor wherein it is conventionally mixed with fuel and ignited to form combustion gases. The combustion gases are channeled through the turbine nozzle to the high pressure turbine which extracts energy therefrom for rotating and powering the compressor.

In one typical embodiment, the OGVs and the combustor diffuser include an annular inner support extending downstream to the turbine nozzle which supports the turbine nozzle. An annular outer support extends radially outwardly from the OGVs and the diffuser and is fixedly connected to the casing surrounding the engine for supporting the OGVs and the diffuser, which, in turn, supports the turbine nozzle.

The turbine nozzle includes a plurality of circumferentially spaced and angled nozzle vanes which conventionally direct the combustion gases into the high pressure turbine. A pressure drop exists across the turbine nozzle and the inner support which generates an axial force which is carried upstream through the inner support, the discharge flowpath, and the outer support to the casing. Since the nozzle vanes are angled, a circumferential component of force is also generated from the combustion gases which results in a torque relative to the engine centerline axis also being transmitted upstream through the inner support and the outer support to the casing.

During an engine thermal transient such as, for example, throttle push, the compressor OGVs and combustor diffuser experience relatively high and nearly instantaneous temperature change due to the relatively hot compressed airflow being discharged from the compressor. Although the inner support responds relatively quickly with the OGVs and the diffuser, the outer support and casing respond relatively slowly to the temperature change. Therefore, the OGVs and diffuser expand more rapidly relative to the outer support which outer support tends to restrain the radial growth thereof resulting in relatively high thermally induced stress at the interface thereof.

The outer support is typically an annular, conical or cylindrical, surface of revolution or shell, which is relatively stiff requiring relatively large forces to cause deflection thereof. The relatively large thermal mass of the OGVs and combustor diffuser create both a radially outward deflection and rotation of the end of the relatively slowly expanding outer support connected thereto, with attendant large thermal stresses therein. In other words, the supporting end of the outer support shell is caused by the expanding OGVs and diffuser to both expand and twist radially outwardly relative to the outer support shell at distances away from its interface with the OGVs and the diffuser.

Accordingly, the relatively quickly expanding OGVs and diffuser expand radially outwardly to a greater extent than the relatively slowly expanding outer support shell resulting in a differential thermal movement, or expansion, therebetween. This differential thermal movement is accommodated by the bending of the outer support shell at its intersection with the OGVs and diffuser resulting in high thermal stress therein.

OBJECTS OF THE INVENTION

Accordingly, one object of the present invention is to provide a new and improved compressor discharge flowpath having reduced thermal stresses due to differential thermal movement between the flowpath and its outer support.

Another object of the present invention is to provide a compressor discharge flowpath effective for reducing such thermal stress while carrying axial force and torque through the outer support from an inner support thereof.

DISCLOSURE OF INVENTION

A compressor discharge flowpath for a gas turbine engine includes flowpath outer and inner walls joined to a plurality of circumferentially spaced flowpath dividers extending therebetween. An inner support extends from the inner wall and is joined to a turbine nozzle, and an outer support extends from the outer wall and is joined to an engine casing. The outer support preferably includes a plurality of circumferentially spaced beams being sized and configured for carrying both axial force and torque transmitted therethrough from the turbine nozzle to the casing while allowing the beams to bend radially for accommodating differential thermal movement between the casing and the outer wall.

BRIEF DESCRIPTION OF DRAWINGS

The novel features characteristic of the invention are set forth and differentiated in the claims. The invention, in accordance with preferred and exemplary embodiments, together with further objects and advantages thereof, is more particularly described in the following detailed description taken in conjunction with the accompanying drawing in which:

MODE(S) FOR CARRYING OUT THE INVENTION

Figure 1:
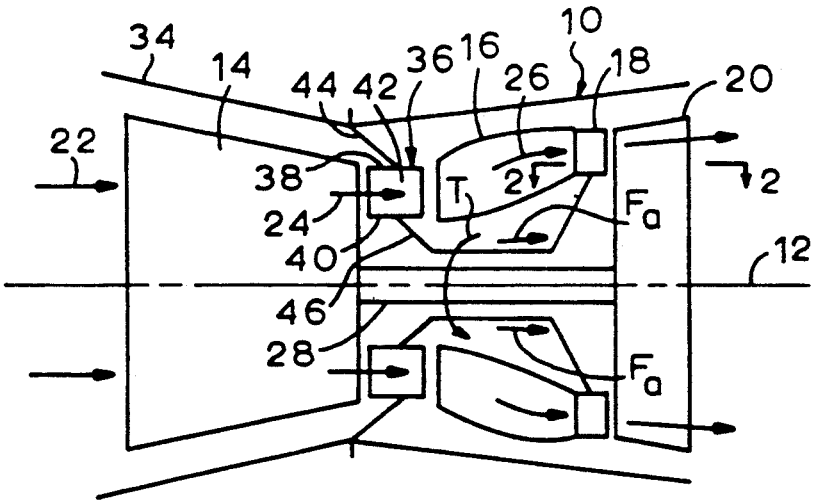
FIG. 1 is a schematic representation of an axial flow gas turbine engine including a compressor discharge flowpath in accordance with one embodiment of the present invention.

Illustrated in FIG. 1 is a schematic representation of a gas turbine engine 10 including in serial flow communication about an axial centerline axis 12 conventional annular and axisymmetric structures including an axial flow compressor 14, combustor 16, high pressure turbine nozzle 18, and high pressure turbine (HPT) 20. The compressor 14 receives inlet airflow 22 which is compressed therein for generating relatively hot compressed airflow 24 which is channeled to the combustor 16 wherein it is conventionally mixed with fuel and ignited for generating combustion gases 26. The gases 26 are channeled into the nozzle 18 and directed thereby through the HPT 20 which extracts energy therefrom for rotating the HPT 20 and in turn rotating and powering the compressor 14 through a conventional shaft 28.

Figure 2:
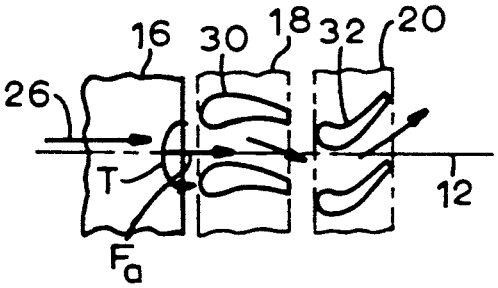
FIG. 2 is a transverse radial view of a portion of the engine illustrated in FIG. 1 taken along line 2—2.

As illustrated in more particularity in FIG. 2, the turbine nozzle 18 includes a plurality of circumferentially spaced nozzle vanes 30 which channel and direct the combustion gases 26 through a plurality of circumferentially spaced turbine blades 32 of the HPT 20. A pressure differential in the combustion gases 26 exists across the nozzle 18 which results in a resultant axial force $F_a$ extending in a downstream direction, and a resultant torque T relative to the centerline axis 12. This axial force $F_a$ and torque T must be suitably transmitted from the nozzle 18 to a conventional annular casing 34 as shown in FIG. 1 surrounding the compressor 14, combustor 16, nozzle 18, and HPT 20.

More specifically, and referring again to FIG. 1, a compressor discharge duct or flowpath 36 is disposed between the compressor 14 and the combustor 16 for channeling the compressed airflow 24 downstream therebetween. The flowpath 36 includes an annular flowpath outer wall 38 and an annular flowpath inner wall 40 spaced radially inwardly from the outer wall 38 both of which are disposed coaxially about the centerline axis 12. A plurality of circumferentially spaced radially extending flowpath dividers 42 extend between and are fixedly joined to the outer and inner walls 38 and 40. An outer support 44 extends axially between and is fixedly joined to the casing 34 and the outer wall 38, and a conventional annular inner support 46 extends axially between and is fixedly joined to the inner wall 40 and the turbine nozzle 18. Since the inner support 46 itself is subject to a pressure differential in the downstream direction below the nozzle 18 due to the compressed airflow 24, as is conventionally known, the axial force therefrom is a substantial component of the axial force $F_a$ which is carried through the flowpath 36.

The axial force $F_a$ and the torque T from the nozzle 18 are effectively carried through the flowpath 36, while differential thermal movement between the outer wall 38 and both the outer support 44 and the casing 34 is accommodated with reduced thermal stress at the juncture of the outer support 44 and outer wall 38 in accordance with one feature of the present invention. The compressor discharge flowpath 36 may, in accordance with the present invention, be in the form of and include either conventional outlet guide vanes or a conventional diffuser while still being effective for carrying the axial force $F_a$ and torque T.

Figure 3:
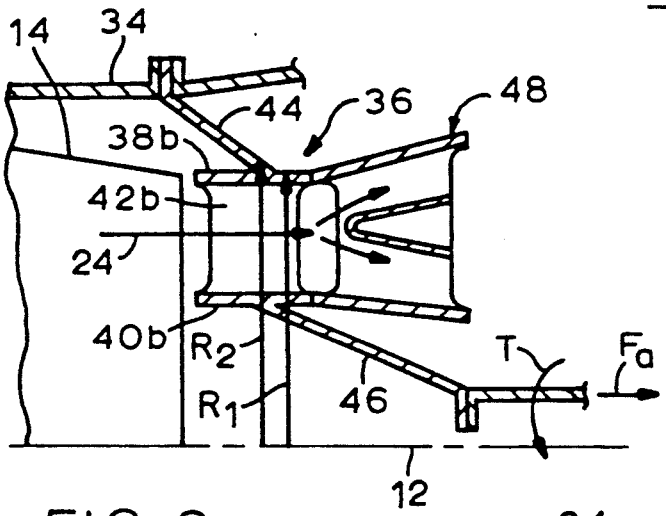
FIG. 3 is an enlarged axial transverse view of the compressor discharge flowpath illustrated in FIG. 1 in accordance with one embodiment of the present invention.

More specifically, the flowpath 36 is illustrated in FIG. 3 in the form wherein the dividers 42 comprise conventional outlet guide vanes (OGVs), designated 42*b*, with the outer and inner walls 38 and 40, designated 38*b*, 40*b*, being fixedly joined thereto by conventional casting, for example. In this embodiment, a conventional diffuser 48 extends downstream from the OGVs 42*b*.

During an engine thermal transient such as conventional throttle push providing an increase in power from the engine 10, the temperature of the compressed airflow 24 increases nearly instantaneously, with the temperature of the OGVs 42*b* also increasing substantially instantaneously therewith. The OGVs 42*b* as measured at the outer wall 38 will expand radially outwardly as a result thereof to a radius $R_1$ relative to the centerline axis 12. Since the outer support 44 is protected from direct contact with the compressed airflow 24 by the outer wall 38*b*, for example, its thermal response is slower than that of the OGVs 42*b* and, therefore, it will expand relatively slower, with its junction with the outer wall 38*b* expanding to a second radius $R_2$ relative to the centerline axis 12. The differential radial movement or expansion between the OGVs 42*b* and the outer support 44 causes the outer support 44 to restrain the radial expansion of the OGVs 42*b* at the outer wall 38*b*. If the outer support 44 were in the form of a conventional annular shell, it would be relatively radially stiff which would result in relatively high thermally induced stress at the juncture between the outer support 44 and the outer wall 38 with attendant bending of the outer support 44 in that region for accommodating the differential thermal movement between the outer support 44 and the outer wall 38*b*. However, the flowpath 36 in accordance with one feature of the present invention includes an improved outer support 44 which is effective for reducing such thermally induced stress at the juncture between the support 44 and the outer wall 38 while accommodating the differential thermal movement between the support 44 and the outer wall 38, as described in more particularity below.

Figure 4:
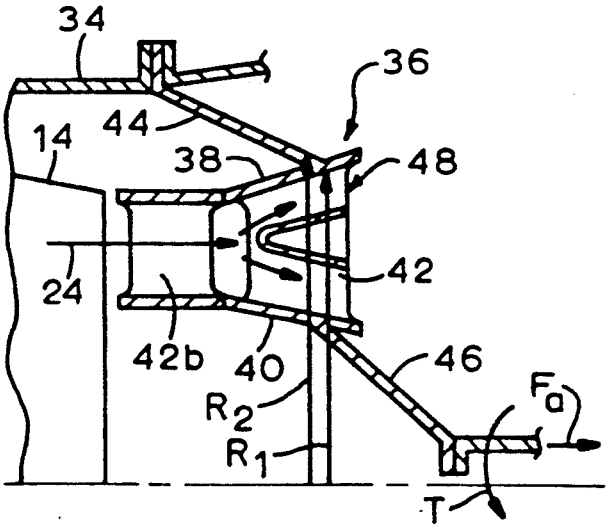
FIG. 4 is an enlarged axial transverse view of the compressor discharge flowpath illustrated in FIG. 1 in accordance with another embodiment of the present invention.

The compressor discharge flowpath 36 may alternatively be in the form of the conventional diffuser 48 as illustrated in FIG. 4. In this embodiment, the outer and inner walls 38 and 40 are the outer and inner walls of the diffuser 48. The embodiments of the invention illustrated in FIGS. 3 and 4 indicate that the load bearing path from the inner support 46 to the outer support 44 may occur either through the conventional OGVs 42*b* or the conventional diffuser 48. The invention is described in further detail below with respect to the diffuser embodiment of the invention, it being understood that the description hereinbelow applies equally well to the OGV 42*b* embodiment of the invention illustrated in FIG. 3.

Figure 5:
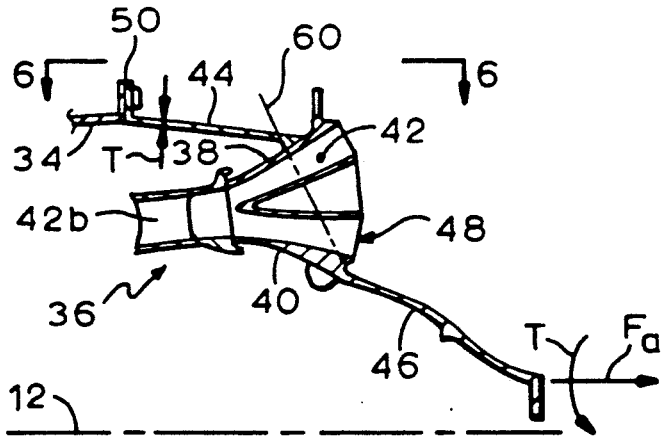
FIG. 5 is an axial transverse view of the compressor discharge flowpath illustrated in FIG. 4 in accordance with another embodiment of the present invention.
Figure 6:
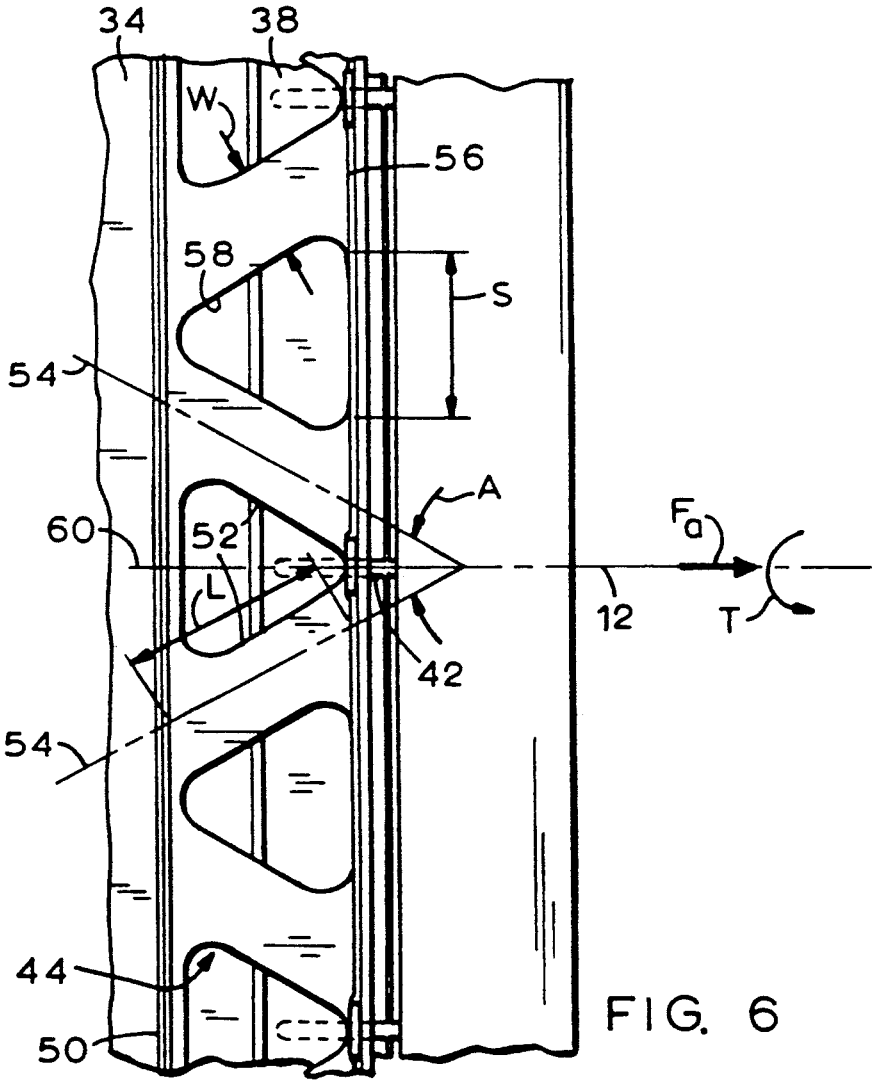
FIG. 6 is a circumferential view of a portion of the compressor discharge flowpath illustrated in FIG. 5 taken along line 6—6.

Illustrated in FIGS. 5 and 6 in more particularity is the compressor discharge flowpath 36 in an embodiment including the diffuser 48 as illustrated in FIG. 4. In this embodiment, the outer support 44 includes an annular mounting flange 50 for conventionally joining the outer support 44 to the casing 34, by bolts for example, and a plurality of circumferentially spaced beams 52 extending integrally from the mounting flange 50 and preferably integrally joined to the diffuser outer wall 38. Each of the beams 52 has a length L along a longitudinal axis 54 thereof, a width W circumferentially transverse thereto, and a thickness T in the general radial direction. The beams 52 are preferably sized and configured in accordance with the present invention for carrying or supporting both the axial force $F_a$ and the torque T transmitted therethrough from the nozzle 18 (FIG. 1) to the casing 34 while allowing the beams 52 to elastically bend radially for accommodating differential thermal movement between the outer support 44, or the casing 34, and the flowpath outer wall 38 for reducing the thermally induced stress at the juncture therebetween below those stresses which would be generated if the outer support 44 were a relatively stiff annular shell.

More specifically, instead of a fully annular shell, the outer support 44 is configured for providing the beams 52 with a predetermined circumferential space S between the aft ends 56 thereof which define the juncture with the outer wall 38. Forward ends 58 of the beams are integrally joined to the mounting flange 50. The circumferential spacing S between the beams 52 breaks the hoop load carrying capability of the outer support 44 allowing for a radially more flexible structure.

In this embodiment, the outer support 44 includes the beams 52 preferably extending generally parallel to the engine centerline axis 12, as illustrated in FIG. 5, for increasing the radial flexibility of the beams 52. More specifically, the thickness T of each of the beams 52 is preferably less than the width W for providing a relatively thin beam 52 with a relatively small moment of inertia in the radial bending direction. The beams 52 are elongate with the beam longitudinal axes 54 being disposed substantially parallel to the engine centerline axis $F_a$ 12 so that the beams 52 are allowed to bend radially relative to the mounting flange 50 for providing additional radial flexibility to accommodate the differential thermal movement between the outer wall 38 and the outer support 44 with reduced thermal stress at the beam aft end 56.

However, the longitudinal load carrying area of each of the beams 52, represented by the product of the width W and the thickness T, is selected in particular designs for accommodating the axial force $F_a$ to be transmitted therethrough. Since the axial force $F_a$ is channeled longitudinally through the beams 52, the beams are relatively stiff in the longitudinal direction compared to being relatively flexible in the radial direction. In this way, a substantial axial force $F_a$ may be carried through the outer support 44 with relatively small axial deflections therein due to the relatively large axial stiffness thereof while the outer support 44 remains relatively flexible in the radial direction.

In the embodiment of the invention illustrated in FIGS. 5 and 6, the flow dividers 42 are in the form of conventional diffuser struts each having a generally radially extending longitudinal axis 60, and the beams 52 are preferably positioned symmetrically relative to the divider longitudinal axes 60 for more effectively carrying the axial force $F_a$ and the torque T.

More specifically, and referring again to FIG. 6, the beams 52 are preferably configured in symmetric pairs, with each beam pair being disposed adjacent to and straddling a respective one of the dividers 42 (shown partly in phantom line) with the longitudinal axes 54 of the beams 52 being equally spaced circumferentially oppositely to the longitudinal axis 60 of the straddled divider 42. The longitudinal axes 54 of the pair of beams 52 preferably intersect each other at an acute angle A which may be up to about 60°. In this way, the beams 52 are disposed in the form of trusses providing axial and circumferential stiffness for more structurally efficiently carrying the axial force $F_a$ and the torque T therethrough. Since the material which would otherwise exist between adjacent ones of the beams 52 in a conventional annular shell is removed, the outer support 44 is relatively light weight. By so configuring the beams 52 with the so angled beam longitudinal axes 54, the length L of each beam is larger for a given axial distance relative to the centerline axis 12 which increases the radial flexibility of the beams 52.

Figure 7:
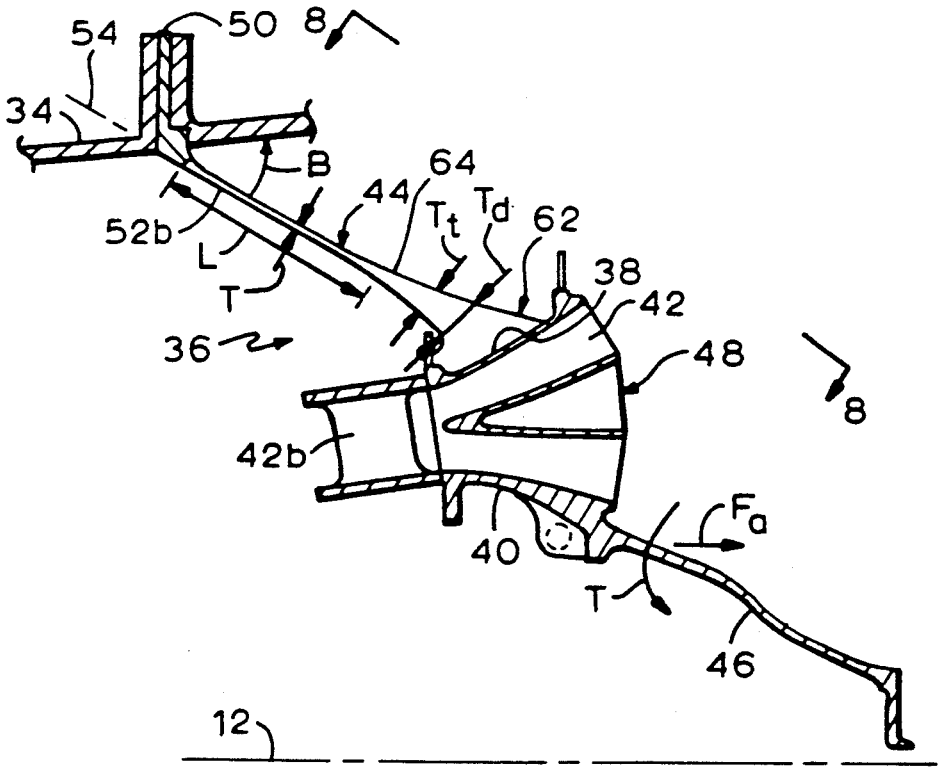
FIG. 7 is an enlarged axial transverse view of the compressor discharge flowpath illustrated in FIG. 1 in accordance with another embodiment of the present invention.
Figure 8:
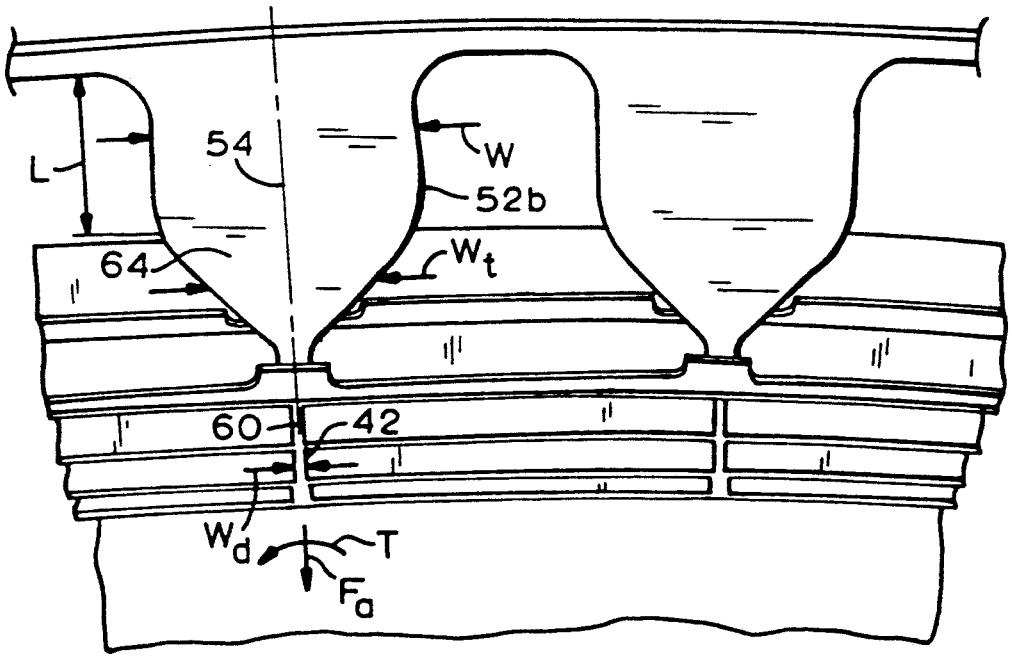
FIG. 8 is a circumferential perspective view of a portion of the compressor discharge flowpath illustrated
Figure 9:
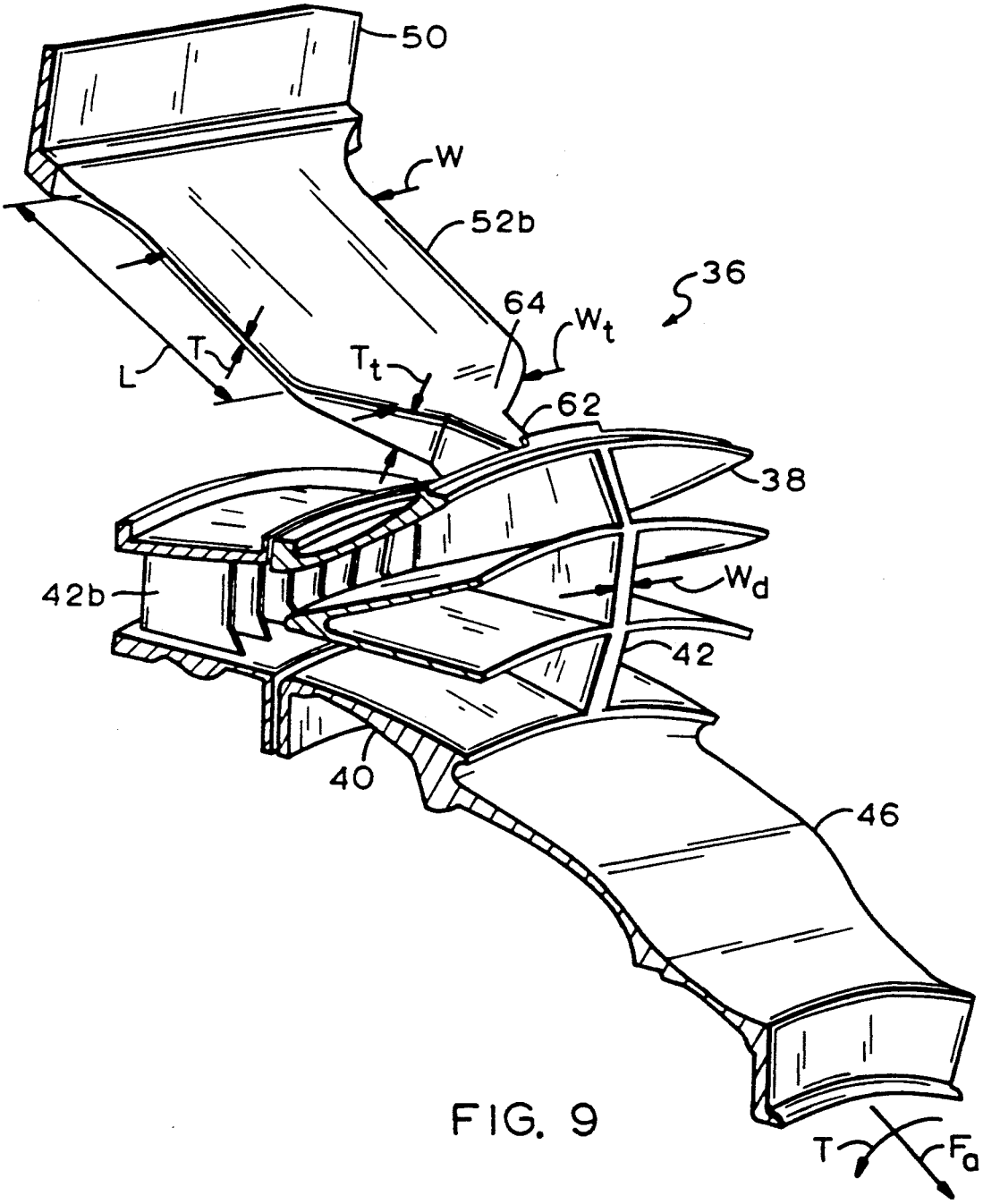
FIG. 9 is a perspective view of a portion of the compressor discharge flowpath illustrated in FIG. 7.

Illustrated in FIGS. 7–9 is the compressor discharge flowpath 36 in accordance with another embodiment wherein the beams 52, designated **52*b*, are in the form of relatively thin, flat plates with one beam 52*b* being disposed adjacent to a respective one of the dividers 42, which is in contrast to the two beams 52 illustrated in FIG. 6 disposed adjacent to a respective one of each of the dividers 42 in that embodiment. In this embodiment, the beam longitudinal axis 54 is axially aligned with the divider longitudinal axis 60 for providing a direct load path for the axial force $F_a$ as illustrated in more particularity in FIG. 8**.

More specifically, each of the dividers 42 preferably includes an extension 62 formed integrally therewith, and extending radially outwardly from the outer wall 38, which is fixedly joined to a respective one of the beams **52*b* for channeling the axial force $F_a$ from the nozzle 18 through the dividers 42 and beams 52*b* to the casing 34. This provides a direct relatively stiff load path, and reduces thermally induced stress in the beam 52*b*. Since the dividers 42 have a relatively larger thermal mass when compared to the outer wall 38, they expand slower relative thereto. By joining the beams 52*b* directly to the dividers 42 through the extensions 62 instead of directly to the outer wall 38 between adjacent ones of the dividers 42, the beams 52*b*** will experience a decreased differential thermal movement with a resulting decrease in thermal stress therein. The direct load path also eliminates or reduces stress risers which could otherwise occur.

Each of the beams **52*b* has a width W in the circumferential direction which is generally constant for the length L of the beams 52*b* along the longitudinal axis 54 for providing circumferential stiffness for effectively transmitting the torque T to the mounting flange 50. Each of the beams 52*b* also has a relatively constant thickness T in the transverse, or generally radial, direction for providing a generally constant load carrying area being the product of the width W times the thickness T for the entire length L for providing axial stiffness to effectively transmit the axial force $F_a$ to the mounting flange 50. The beam width W is preferably greater than the circumferential width $W_d$ of each of the respective dividers 42**.

Since each of the dividers 42 is in the form of a radially extending plate, and each of the beams **52*b* is in the form of a circumferentially extending plate, a beam transition 64 is provided to fixedly join the beam 52*b* to a respective divider 42 for providing a transitioning load carrying structure therebetween which eliminates or reduces stress risers. The beam transition 64 has a varying circumferential width W which decreases from the beam width W to the divider width $W_d$, and a transversely, or radially, varying thickness T which increases from the thickness T of the beam 52b to the thickness $T_d$ of the divider extension 62. In this way, the length L of the beam 52b may be made as large as possible within the axial space permitted with a relatively short beam transition 64 integrally joining the beam 52b to the divider extension 62. Accordingly, radial flexibility of the beam 52b is enhanced while still providing relative axial stiffness along the longitudinal axis 54, due to the load bearing area of the product of the width W and the thickness T, and circumferential stiffness, due to the constant width W, both without introducing stress risers. The thickness T of the beam 52b is preferably less than its width W for providing increased radial flexibility for accommodating the differential thermal movement between the outer support 44 and the outer wall 38**.

In order to further increase the radial flexibility of the beams 52b while maintaining relatively large axial stiffness therein, the beam longitudinal axis 54, as illustrated in FIG. 7, is disposed at an angle B relative to the engine centerline axis 12 which is preferably up to about 45°. For a given axial space permitted for the beams 52b, the so inclined beams 52b will necessarily have a longer length L, as compared to parallel beams 52b with B equal to zero, which increases the radial flexibility thereof. Increased radial flexibility of the beams 52b allows the beams to elastically bend with corresponding reductions in thermal induced stress at the juncture between the beams 52b and the divider extension 62.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States as the invention as defined and differentiated in the following claims.

We claim:

1. For a gas turbine engine having an axial centerline axis, a compressor for discharging compressed airflow, a combustor for receiving said compressed airflow and generating combustion gases, a turbine nozzle for receiving said combustion gases, and a casing surrounding said compressor, combustor, and nozzle, an annular compressor discharge flowpath for channeling said compressed airflow from said compressor to said combustor comprising:

a flowpath outer wall;

a flowpath inner wall spaced from said outer wall;

a plurality of circumferentially spaced radially extending flowpath dividers extending between and fixedly joined to said outer and inner walls, each of said dividers having a longitudinal axis;

an annular inner support fixedly joined to said inner wall and extending axially for being joined to said turbine nozzle;

an outer support fixedly joined to said casing and extending axially for being joined to said outer wall, and comprising a plurality of circumferentially spaced beams each having a length along a longitudinal axis, said beams being sized and configured for carrying both axial force and torque transmitted therethrough from said nozzle to said casing while allowing said beams to bend radially for accommodating differential thermal movement between said casing and said outer wall; and said beams being configured in symmetric paris, with each beam pair being disposed adjacent to and straddling a respective one of said dividers, with said longitudinal axes of said beam pair being equally spaced circumferentially oppositely to said longitudinal axis of said straddled divider.

2. A compressor discharge flowpath according to claim 1 wherein said beam pair longitudinal axes intersect each other at an acute angle.

3. A compressor discharge flowpath according to claim 2 wherein said beam longitudinal axes are disposed substantially parallel to said engine centerline axis for providing radial flexibility to accommodate said differential thermal movement.

4. A compressor discharge flowpath according to claim 3 wherein each of said beams includes a width and a thickness, said thickness being less than said width for providing radial flexibility to accommodate said differential thermal movement.

5. A compressor discharge flowpath according to claim 4 in the form of a diffuser, wherein said flowpath dividers are struts therein.

6. For a gas turbine engine having an axial centerline axis, a compressor for discharging compressed airflow, a combustor for receiving said compressed airflow and generating combustion gases, a turbine nozzle for receiving said combustion gases, and a casing surrounding said compressor, combustor, and nozzle, an annular compressor discharge flowpath for channeling said compressed airflow from said compressor to said combustor comprising:

a flowpath outer wall;

a flowpath inner wall spaced from said outer wall;

a plurality of circumferentially spaced radially extending flowpath dividers extending between and fixedly joined to said outer and inner walls;

an annular inner support fixedly joined to said inner wall and extending axially for being joined to said turbine nozzle;

an outer support fixedly joined to said casing and extending axially for being joined to said outer wall, and comprising a plurality of circumferentially spaced beams each having a length along a longitudinal axis, said beams being sized and configured for carrying both axial force and torque transmitted therethrough from said nozzle to said casing while allowing said beams to bend radially for accommodating differential thermal movement between said casing and said outer wall; and each of said flowpath dividers including an extension extending radially outwardly from said outer wall and fixedly joined to a respective one of said beams for channeling said axial force from said nozzle through said dividers and beams to said casing.

7. A compressor discharge flowpath according to claim 6 wherein each of said beams has a width being greater than a width of said respective divider.

8. A compressor discharge flowpath according to claim 7 wherein said beam includes a beam transition fixedly joining said beam to said respective divider extension, said beam transition having a width decreasing from said beam width to said divider width and a thickness increasing from said beam to said divider extension.

9. A compressor discharge flowpath according to claim 8 wherein each of said beams includes a thickness being less than said beam width for providing radial flexibility to accommodate said differential thermal movement.

10. A compressor discharge flowpath according to claim 9 wherein said beam longitudinal axis is disposed at an angle relative to said engine centerline axis up to about 45° for providing radial flexibility to accommodate said differential thermal movement.

11. A compressor discharge flowpath according to claim 10 in the form of a diffuser wherein said flowpath dividers ar struts therein.

12. A compressor discharge flowpath according to claim 10 wherein said flow dividers are outlet guide vanes.

13. A compressor discharge flowpath according to claim 10 wherein each of said beams is disposed adjacent to a respective one of said dividers with said beam longitudinal axis being axially aligned with a longitudinal axis of said divider.

* * * * *